US007338418B2

(12) United States Patent
Erez

(10) Patent No.: US 7,338,418 B2
(45) Date of Patent: Mar. 4, 2008

(54) ASSEMBLY FOR STABILIZING SEATED INDIVIDUALS WHILE EXERCISING

(76) Inventor: Miki Erez, 12505 SW. 88 Ct., Miami, FL (US) 33176

( * ) Notice: Subject to any disclaimer, the term of this patent is extended or adjusted under 35 U.S.C. 154(b) by 122 days.

(21) Appl. No.: 11/102,147

(22) Filed: Apr. 8, 2005

(65) Prior Publication Data

US 2006/0229176 A1 Oct. 12, 2006

(51) Int. Cl.
*A63B 23/00* (2006.01)

(52) U.S. Cl. ..... 482/148; 482/69; 482/78; 119/770

(58) Field of Classification Search ..... 482/69, 482/78, 123, 148; D29/101.1; 244/151 R; 119/770

See application file for complete search history.

(56) References Cited

U.S. PATENT DOCUMENTS 4,153,244 A 5/1979 Tauber, Jr.
4,966,362 A 10/1990 Ramaekers
5,100,128 A 3/1992 Mabry et al.
5,180,030 A * 1/1993 Smaby ..... 182/187
5,277,685 A 1/1994 Gonzales
5,709,631 A 1/1998 Kleinsasser
5,762,593 A 6/1998 Whiteley
5,839,995 A 11/1998 Chen
5,988,098 A * 11/1999 Hillhouse ..... 114/347
6,036,623 A 3/2000 Mitchell

* cited by examiner

*Primary Examiner*—Lori Amerson
(74) *Attorney, Agent, or Firm*—Malloy & Malloy, P.A.

(57) ABSTRACT

An assembly for stabilizing an individual while exercising in a seated position, such as, but not limited to, a wheelchair. A harness assembly comprises a plurality of harness structures each intended to be removably secured to a different part of the individual's body in a manner which stabilizes that body portion while performing a particular exercise. A restraint assembly comprises a plurality of restraint members interconnected to each of the plurality of the harness structures being used and to an anchor assembly, disposed in underlying, supporting relation to the individual and the support structure. The restraint assembly is cooperatively structured with the anchor assembly to maintain any of the harness structures being utilized and the corresponding body portion in a stable, operative position best suited to effectively perform the intended exercise.

31 Claims, 4 Drawing Sheets

ASSEMBLY FOR STABILIZING SEATED INDIVIDUALS WHILE EXERCISING

BACKGROUND OF THE INVENTION

1. Field of the Invention

This invention is directed to an assembly to stabilize individuals while seated in a wheelchair or other support structure such that predetermined portions of a user's body which are primarily involved in an exercise being performed are stabilized and maintained in an operative position necessary to correctly perform the exercise.

2. Description of the Related Art

In today's fast paced society, exercise has become an increasingly important part of many individuals' lives. It is well established that a regular exercise program in addition to a proper diet serve to increase the ones overall health and facilitate the ability to follow an active, full rounded lifestyle. In an effort to take advantage of a significant part of the population being involved in regular exercise programs, industries involved with exercise apparatus and devices have made available a plurality of different exercise machines, apparatus, procedures, programs etc. to aid the average individual in accomplishing a full range of exercise in order to benefit the entire body.

Clearly, the vast majority of known, commercially available exercise machines and like assemblies are designed, structured and configured for the average, active individual who has full use of his or her body. However, in fairly recent times it has been recognized that physically restricted individuals, including the elderly as well as invalids, also significantly benefit from a regular exercise program. Exercise programs for such restricted individuals have been modified to suit specialized needs due in part to the fact that both the active and relatively inactive portions of an individual's body benefit from regular exercise. Similarly, individuals who have reached an advanced age may have lost partial or efficient use of certain parts of the body such as the joints associated with the legs, hips, arms, etc. It has also been determined that elderly individuals of the type described also significantly benefit from a continued and appropriate exercise program which serves to increase the range of motion of the various parts of the individual's body as well as improving ones overall fitness profile.

However, for invalids, the elderly and other select groups of individuals, it is necessary or more comfortable to perform at least some of the individual exercises of a predetermined exercise program while being seated. In the case of certain traumatically injured or otherwise restricted individuals, it may be required to perform the intended exercise program from a wheelchair or other support structure. As such, the individual is capable of a certain degree of mobility and independence while being able to maintain in a comfortable, seated orientation.

In order to facilitate the exercise of individuals, while in a seated position, wheelchairs and like support structures, as well as the exercise assemblies and/or apparatus have been customized by including certain structural modifications not typically found in corresponding exercise apparatus used by individuals having a full and unfettered range of motion of their body parts. By way of example, modified exercise bicycles or a similar category of structures, are known and commercially available, wherein both active and inactive parts of a user's body may be exercised. Similarly, treadmill like structures are available which have been structurally modified to adapt the use thereof to individuals having a restricted field of motion of at least certain body parts.

Similarly, some treadmill-like roller arrangements are specifically designed and structured to be used in combination with wheelchairs and include a specialized wheelchair support disposed above or in a predetermined orientation relative to the supporting frame of the treadmill. In addition, certain wheelchairs have been modified from a substantially conventional structural configuration, which enables their use with various types of customized or conventional exercise apparatus.

Accordingly, while structural and operational modifications, of the type generally set forth above, are assumed to be at least partially suited for their intended function, the majority of such structural modifications must be adaptive with other known or specialized exercise assemblies in order for an exercise program to be performed. Clearly, customization of the type referred to is expensive, not widely available in the market place and oftentimes involves a restriction of the normal function or performance of wheelchairs or like support structures as originally intended.

Accordingly, there is a significant and long established need in this area for an assembly which facilitates the stabilization of an individual while performing exercise in a seated position. Further, such an assembly, if developed, should overcome the problems and deficiencies of equipment presently available, such as generally set forth above. Most preferably, a stabilization assembly of the type referred to should allow a restricted individual to perform a variety of different and appropriate exercises using both the active and inactive portions of the user's body, if desired. Moreover, such a preferred stabilizing assembly should allow a physically restricted individual to exercise using substantially conventional and commercially available exercise equipment thereby avoiding the cost and other disadvantages associated with use of exercising apparatus customized for physically restricted individuals. Also, the various structural and operative components of a preferred stabilizing assembly should be easy to use, install and assemble, thereby allowing the restricted individual to perform intended and appropriate exercise programs in a manner which does not significantly depend on others. Finally, a preferred assembly of the type used to stabilize seated individuals while exercising, should be comfortable and comprise a structural integrity which would render the assembly available at a reasonable cost while being operative over an extended operable life.

SUMMARY OF THE INVENTION

The present invention is directed to an assembly which serves to stabilize a seated individual and more specifically, at least predetermined portions of the individual's body while the individual is exercising. As such, the stabilizing assembly is intended for use by those individuals who may be physically restricted at least to the extent of having one or more portions of their body being entirely or partially incapable of use or movement through a normal range of motion. Such a category of individuals may include invalids, who have lost at least partial use of a portion of their body because of trauma, disease, age, etc. Further, the structural and operational versatility of the assembly of the present invention is such as to stabilize different portions of a user's body in order to effectively perform a plurality of exercises which may collectively represent an appropriate exercise routine.

Accordingly, the assembly of the present invention comprises a harness assembly including at least one but more practically a plurality of harness structures each of which comprise a dimension, configuration and overall structure which allows each of the harness structures to be secured to at least one different, predetermined portion of an individual's body. The particular harness structure utilized, as well as the body part to which it is attached, is of course dependent, at least in part, on the particular exercise being performed. Moreover, the structural and operative features of each of the plurality of harness structures are such as to maintain or stabilize the corresponding body portion during the performance of the exercise such that the exercise is properly performed thereby providing maximum benefit to the individual. As explained in greater detail hereinafter, each of the harness structures may be used independently and/or in combination with one another again depending, at least in part, on the specific exercise being performed.

Stabilization of the individual is also accomplished by a cooperative structuring and disposition of a restraint assembly and an anchor assembly both included as operative parts of the stabilization assembly. More specifically, the restraint assembly is connected to the one or more harness structures mounted on the individual and is removably attached to the anchor assembly. The anchor assembly is disposed in supporting relation beneath the individual and the wheelchair or other support structure in which the individual is seated. As such, the anchor assembly is disposed and structured, by virtue of its connection with the restraint assembly, to at least partially restrict motion or movement of the predetermined portion of the user's body to which the harness is attached. Accordingly, the individual is able to maintain an operative position required to effectively perform a given exercise. As should be apparent, the absence of proper stabilization of at least the body portion primarily involved in a given exercise would frequently result in the inability to perform the exercise or the exercise being improperly performed.

In order to allow an individual to perform a variety of different exercises and thereby provide benefit to various portions of his or her body, the plurality of harness structures may vary from one another in both size and configuration, dependent at least in part on the portion of the body to which it is to be attached. By way of example, the plurality of harness structures may include a vest or vest-like structure including one or more harness segments disposed and structured to surround the waist, chest and back of the individual. Also, the vest structure may include two shoulder straps disposed in overlying relation to the shoulders of the wearer and disposed in interconnecting relation between the front and back portions of the vest.

Another of the plurality of harness structures may be specifically intended to overlie and cover a portion of the "lap" of the individual while in the seated position. Also, the plurality of harness structures may include a generally annular member of sufficient dimension and configuration to fit over the individual's head and/or somewhat surround the neck of the individual while being outwardly spaced there from in overlying relation to at least an inner portion of the shoulders or other body area adjacent the neck of the individual. Further, this annular member may be dimensioned and configured to also surround and restrictively engage the waist or hip area of the individual thereby enabling it to stabilize different portions of the individual's body dependent, as set forth above, on the exercise being performed as well as a variety of other factors.

It is emphasized that the various harness structures, as described above, are representative only of a larger number of harness structures which may define the harness assembly. In addition, any other harness structures may be used independently of the above more specifically described harness structures or may be used in combination therewith. Further by way of example, the harness assembly may also comprise an auxiliary harness structure including an elongated, rigid material bar or shaft secured to the shoulder straps of the vest-like harness structure so as to extend outwardly from a frontal portion the vest structure. Additional structural and operative features of the auxiliary harness structure, as well as others of the plurality of harness structures, will be described in greater detail hereinafter.

As also set forth above, a primary function of the restraint assembly is to stabilize each of the plurality of harness structures utilized by interconnecting and thereby "anchoring" the harness structures to the anchor assembly. In doing so, the harness structures and the corresponding body portions to which they are attached, will be at least partially restrained from undesirable movement which may be caused by a resistance or reaction force being placed on that corresponding body portion during the performance of the various exercises. Therefore, the restraint assembly comprises a plurality of restraint members connected to the one or more harness structures being utilized and removably connected, at a spaced apart locations, to the anchor assembly.

A specific location of interconnection between the harness structure utilized and the anchor assembly is again dependent upon the dimension, configuration and structure of the harness structure being utilized and the exercise being performed. Therefore, the anchor assembly preferably comprises a support platform having a plurality of attachment members disposed in spaced apart relation thereon. Each of the attachment members is cooperatively structured with the plurality of restraint members to facilitate removable connection therebetween. Also, a spaced apart array of attachment members on the support platform allows for the selective positioning of the plurality of restraint members such that an adequate and predetermined restraining or stabilizing force can be exerted on the harness structure in order to stabilize the body part to which it is attached.

As generally set forth above, a most preferred embodiment of the present invention comprises the anchor assembly being defined by a support platform on which the wheelchair or other support structure supporting the individual is mounted. Therefore, it should be readily apparent that the weight of the wheelchair or other support structure as well as the weight of the individual serves to render the support platform of the anchor assembly in a secured, intended position thereby allowing it to provide sufficient anchoring force to the harness assembly through interconnection therewith by the restraint assembly.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

As shown in the accompanying drawings, the present invention is directed to an assembly for stabilizing an individual while exercising in a seated position. The seated positioning of the exercising individual may be based on a need of the individual to use a wheelchair or any of a variety of other support structures (not shown for purposes of clarity). Moreover, as used herein the term "support structure" may or may not be mobile in terms of providing the mobility of a conventional wheelchair. Further, the stabilizing assembly 10 of the present invention may be used with any of a variety of conventionally structured and operable wheelchairs and/or other support structures, which are capable of positioning a seated individual in direct access to any of a the exercise assembly being used. It is also emphasized that the stabilizing assembly 10 of the present invention may be used with any of a variety of conventional exercise apparatus, assemblies, etc. such as of the type utilized either in a gym, therapeutic center, home environment, etc. Accordingly, for purposes of clarity a particular exercise assembly, etc. is not shown.

Moreover, the structural and operative features of the stabilizing assembly generally indicated as 10 serve to overcome many of the disadvantages and deficiencies of known or conventional devices by allowing an individual to utilize exercise equipment which is not specifically customized or modified for use by seated individuals. Similarly, the stabilizing assembly 10 of the present invention may be utilized with any of a variety of conventional wheelchair or other support structures without requiring a customization thereof.

More specifically, the stabilizing assembly 10 comprises a harness assembly including at least one but more practically a plurality of harness structures. As shown throughout the accompanying figures, the plurality of harness structures of the harness assembly 10 comprise a vest structure generally indicated as 12, a lap structure generally indicated as 14, an annular member generally indicated as 16 and an auxiliary member generally indicated as 18. The specific description of these individual harness structures is not intended to be limiting as to the number of different harness structures which define the aforementioned harness assembly of the stabilizing assembly 10. To the contrary, the detailed description provided hereinafter of the individual harness structures 12, 14, 16, 18, etc. is representative only of additional harness structures which may be utilized. The number, configuration, dimension, structure, etc is at least partially dependent on the different exercises being performed as well as arrangement, disposition and/or structural configuration of the exercise apparatus used by an individual to which one or more of the harness structures 12, 14, 16, 18, etc. are mounted.

Figure 2:
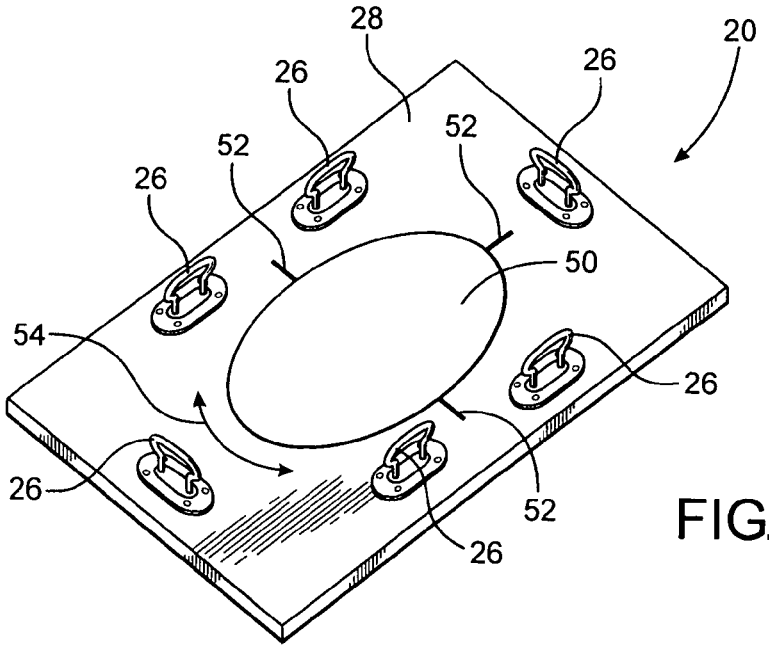
FIG. 2 is a perspective view of an anchor assembly of one preferred embodiment of the assembly of the present invention which is operatively associated with the embodiment of FIG. 1.
Figure 2A:
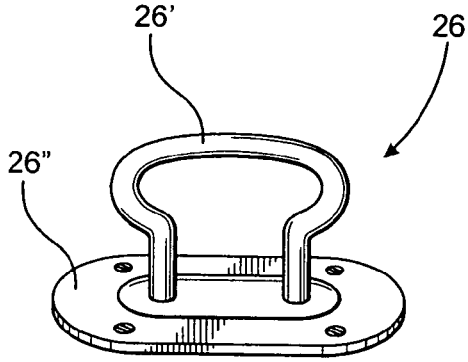
FIG. 2A is a perspective detailed view of a component of the anchoring assembly of the embodiment of FIG. 2.

In addition, the stabilizing assembly 10 of the present invention further comprises an anchor assembly generally indicated as 20 and a restraint assembly generally indicated as 22. In use, the restraint assembly 22 comprises a plurality of restraint members 23 attached to one or more of the harness structures 12, 14, 16, 18, etc, being utilized and being removably connected to the anchor assembly 20. Removable connection of the plurality of restraint members 23 to the anchor assembly 20 is accomplished by virtue of a plurality of attachment members 26 located in spaced relation to one another about a support platform 28. The support platform defines at least a portion of the anchor assembly 20, and as described in greater detail hereinafter, is intended to be disposed in underlying, supporting relation to a participating individual and the wheelchair or other support structure in which the individual is seated. As represented in detail in FIG. 2A at least one embodiment of the attachment members 26 comprises an upper exposed portion 26' to which a connector 31 of the restraint member 23 may be removably attached. A lower or base portion 26" may be connected to the support platform 28.

Cooperative structuring and disposition of the anchor assembly 20 and the restraint assembly 22 facilitates restraint and stabilization of the corresponding portion of the individual's body to which one or more of the plurality of harness structures 12, 14, 16, 18, etc. are attached. Such stabilization comprises the corresponding part of the body being substantially maintained in an operative position while an exercise is being performed. Therefore, the corresponding portion of the user's body affected by the performance of a given exercise will not be displaced out of an intended, operative position necessary to effectively perform the exercise.

Accomplishing such stabilization of each of the various portions of an individual's body involves the selective disposition of the plurality of restraint members 23 into a predetermined interconnected position between the one or more harness structures 12, 14, 16, 18, etc. secured to the individual and the support platform 28. Therefore, the spaced apart array of the attachment members 26 allow the user to interconnect each of the plurality of restraint members 23 being utilized to an appropriate one of the attachment members 26 in order to properly "anchor" the harness structures 12, 14, 16, 18, etc. and thereby maintain a corresponding portion of the individual's body in the aforementioned operative position.

As should be apparent, a different number of restraint members 23 may be utilized dependent on which of the plurality of harness structures are mounted on an individual's body. Further, the point of connection of each of the restraint members 23 both to the particular harness assembly and to the support platform 28 will be dependent on the structure and configuration of the particular harness structure 12, 14, 16, 18, etc. being utilized as well as the exercise being performed. Naturally, other factors may affect the number and placement of restraint members 23 needed to interconnect the harness assembly to the support platform 28 such as, but not limited to, the weight or size of the individual and/or any specific physical restrictions of the individual.

Figure 6:
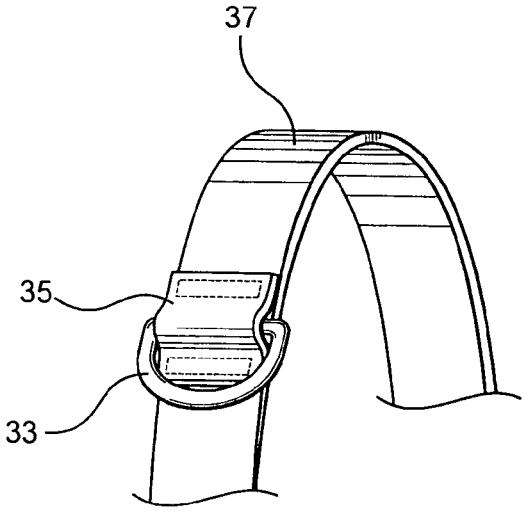
FIG. 6 is a detailed view in partial cutaway of one of a plurality of loop-type connectors secured to each of the harness structures.

As will be described in greater detail hereinafter, each of the plurality of restraint members 23 is preferably formed from a flexible material strap, cord, cable or like structure which may be adjustable in length and which includes an outer or distal end 23' removably connected to an appropriate one of a plurality of attachment members 26. Such removable connection may be accomplished by a snap hook or other substantially conventional connectors generally indicated as 31. The opposite or proximal end 23" may be removably or fixedly connected to an appropriate one of the harness structures 12, 14, 16, 18, etc. When removably connected, a similar snap hook or like connector 31 may be secured to the proximal end 23" and be attached to a loop type connector 33 shown in detail in FIG. 6. Each of a plurality of loop typeconnectors 33 may be mounted by a secured patch or flap 35 or by a variety of other means which facilitates access to the connector 33 by the removable or snap hook or other appropriate connector 31 described above.

Figure 1:
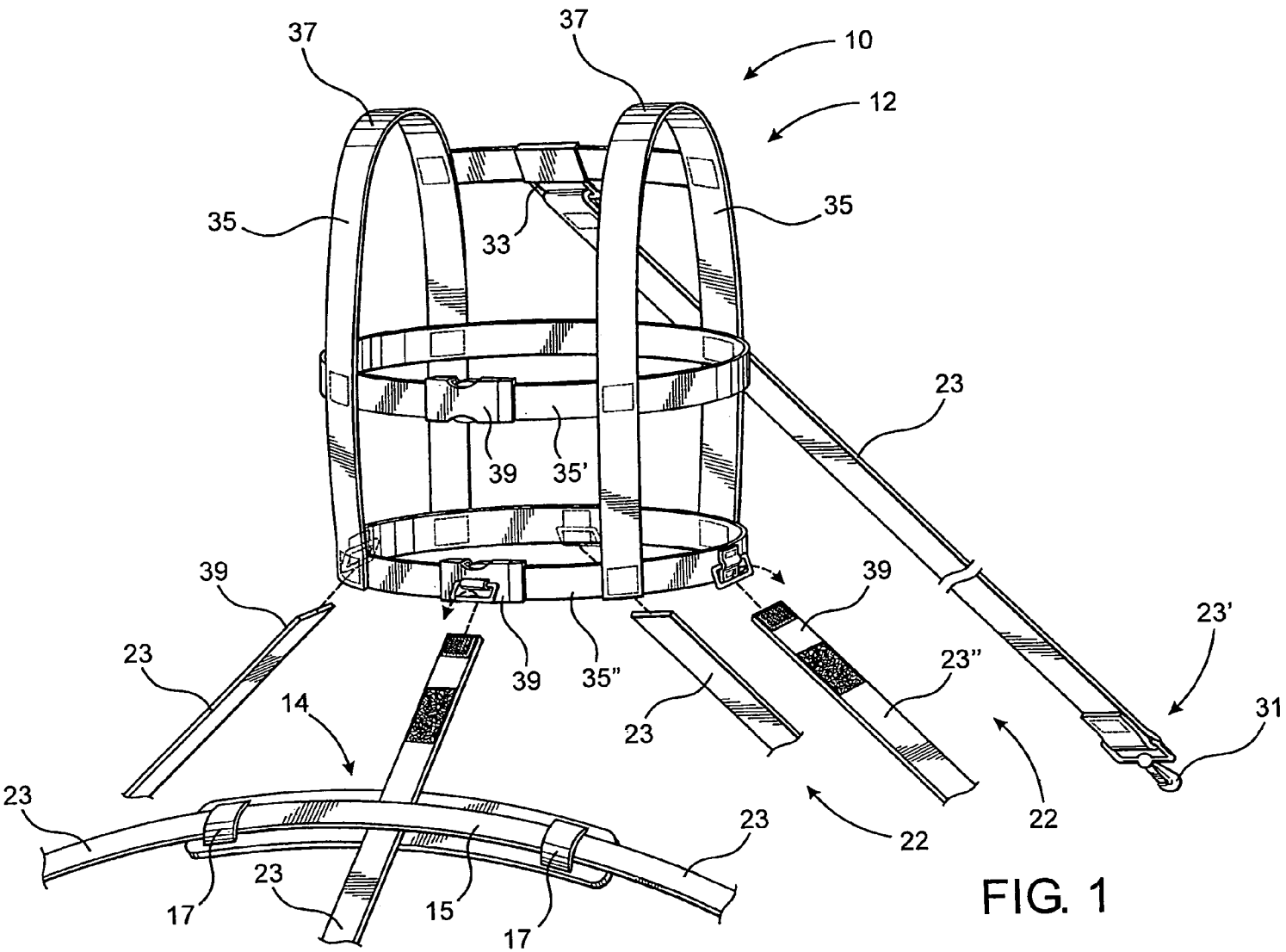
FIG. 1 is a perspective view of at least a portion of one preferred embodiment of the stabilization assembly of the present invention.
Figure 3:
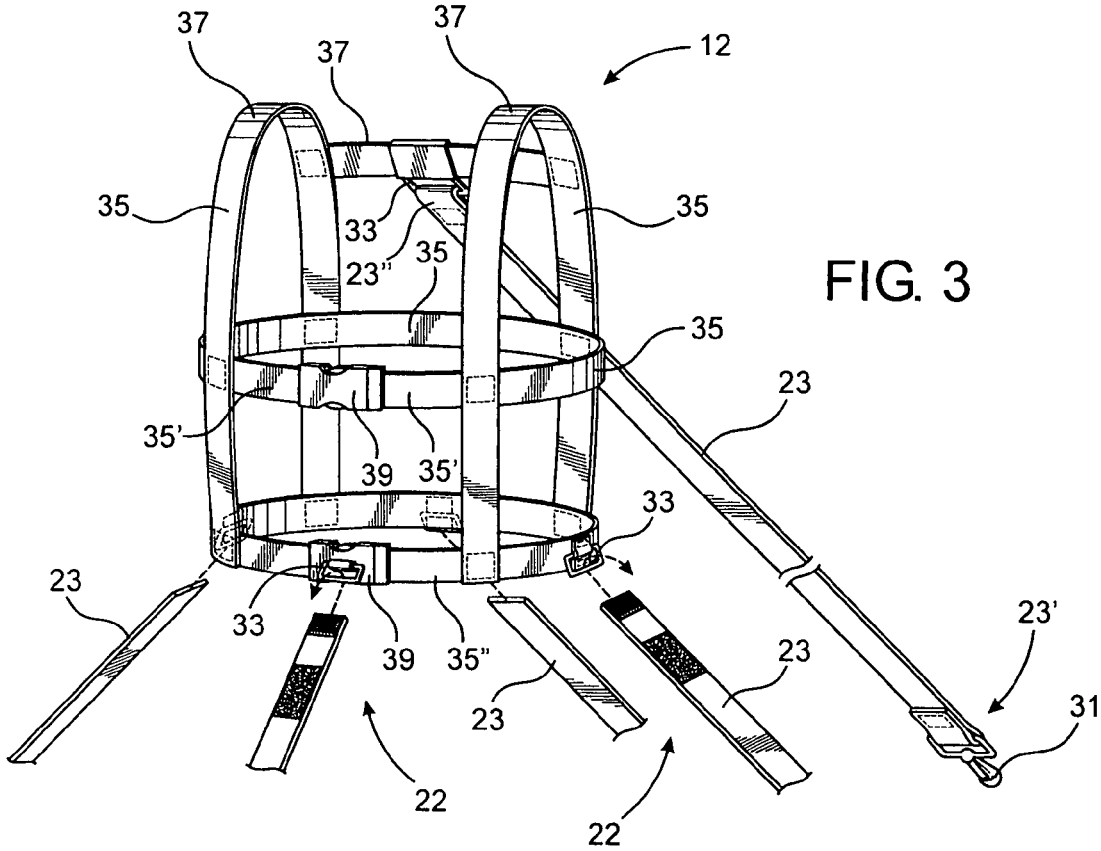
FIG. 3 is a perspective view of one of the harness structures associated with the embodiment of FIG. 1.
Figure 4:
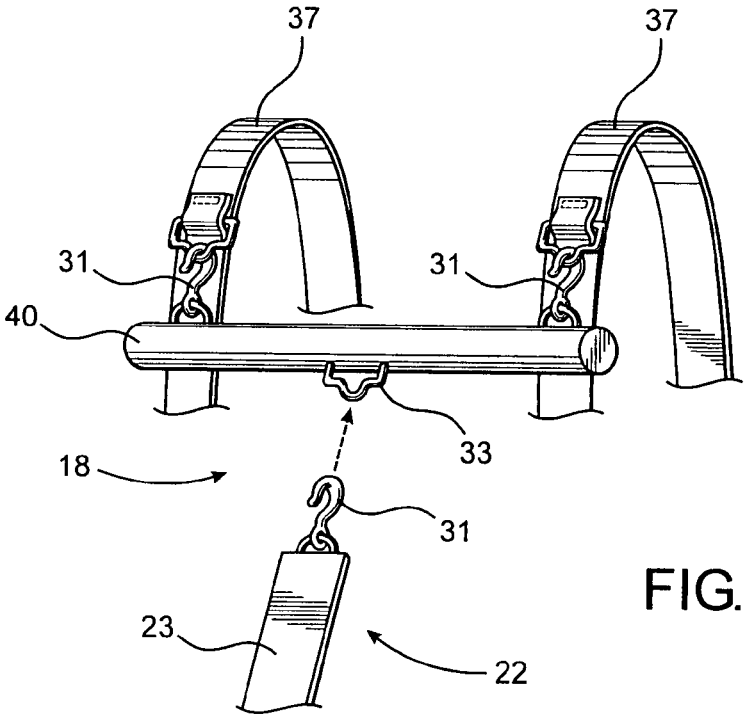
FIG. 4 is a detailed perspective view in partial cutaway of yet another preferred embodiment of the present invention comprising a different harness structure than that represented in FIGS. 1 through 3.
Figure 5:
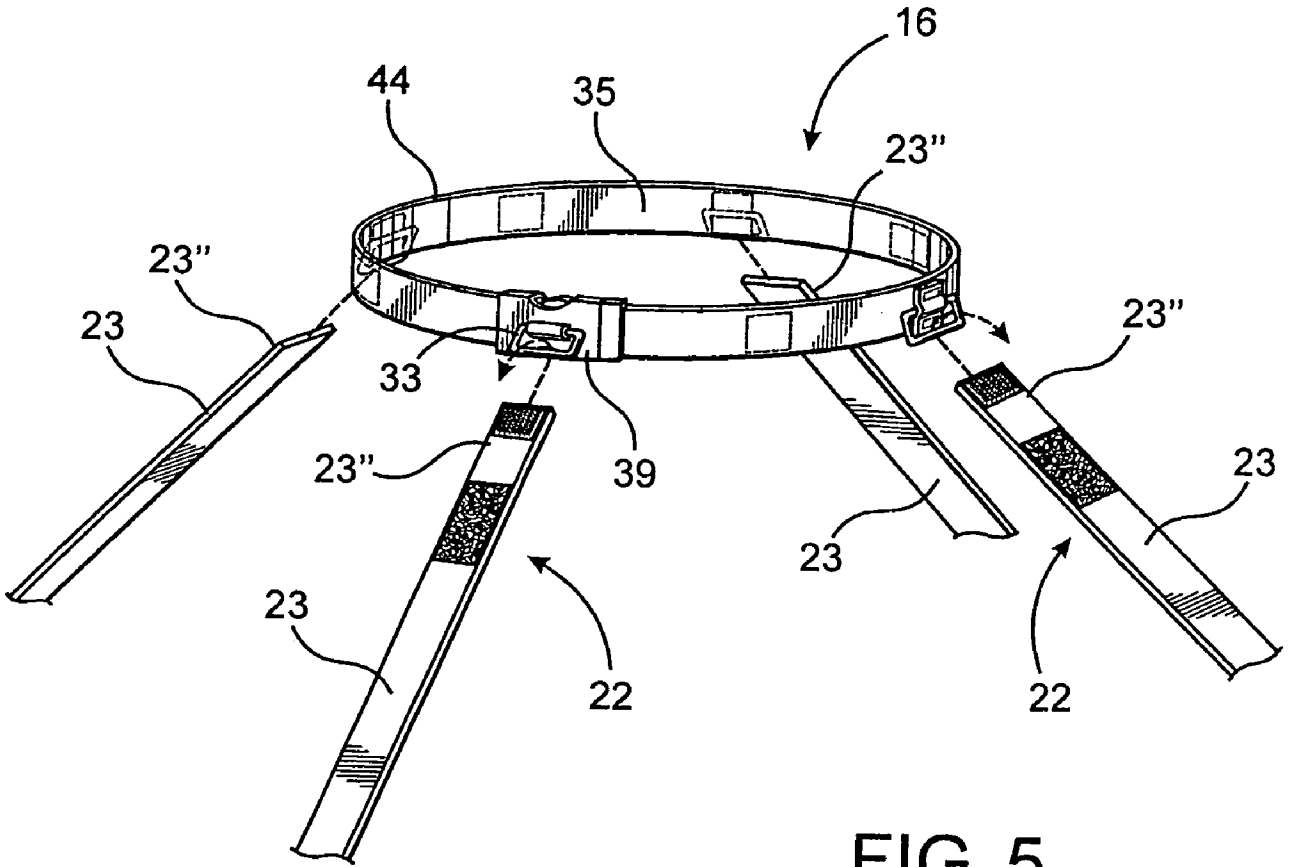
FIG. 5 is yet another preferred embodiment of the harness structure of the harness assembly of the present invention.

With primary reference to FIGS. 3, 4 and 5, each of the plurality of harness structures 12, 14, 16, 18, etc, comprise one or more harness segments 35 preferably, but not necessarily, in the form of straps or like elongated members. As represented in FIGS. 1 and 3, the harness structure 12 is structured and configured to define a "vest" including a plurality of harness segments 35 fixedly or integrally secured to one another so as to substantially surround and embrace the front, back, side and waist portions of the middle and upper torso of an individual. In addition, the vest-like harness structure 12 also includes two spaced apart shoulder straps 37 also defined by appropriately disposed and structured harness segments 35. The shoulder straps 37 overlie the shoulders of the individual while the frontal portion overlies the chest area and waist portion as at 35' and 35" respectively. Similarly, the sides and rear of the vest harness structure 12 include a plurality of spaced apart integral or fixedly interconnected harness segments 35 appropriately positioned to provide stabilization to the portion of the individual's body to which it is connected. As represented in FIG. 3, the plurality of restraint members 23 may be attached at any of a plurality of different locations by the aforementioned connectors 33. In addition to the above, buckles, hook and loop type fasteners or other detachable connectors 39 may be appropriately disposed to facilitate mounting and removal of the various harness structures 12, 14, 16, 18, etc. from the appropriate or corresponding portion of the individual's body.

As also represented in FIG. 1, the harness assembly comprises a lap restraining harness structure 14 structured and operatively disposed to overlie the lap or upper thighs of an individual. More specifically, the lap harness structure 14 comprises a substantially elongated body portion 15 having fixed or integrally structured loops 17 dimensioned and configured to allow passage of one or more restraint members 23 there through. The width or transverse dimension of the lap harness structure 14 is sufficient to provide proper resistance to the thighs of an individual thereby at least partially restricting movement thereof and maintaining the legs of the individual in an appropriate operative position depending on the exercise being performed. As also represented, the lap harness structure 14 may be connected to an additional one of the restraint members 23 connected to the vest harness structure 12 or be positioned independent thereof.

With primary reference to FIG. 4, one of the plurality of harness structures 18 comprises an elongated substantially rigid material shaft or bar 40 connected to each of the shoulder straps 37 and removably attached by appropriate connectors 31 thereto. The bar 40 therefore extends outwardly from a frontal portion of the vest like harness structure 12 and may be secured to one or more of the plurality of shoulder straps 37 by an appropriate connector 31 as described.

At least one preferred embodiment of the stabilizing assembly 10 of the present invention further comprises an additional harness structure 16 as represented in FIG. 5. This harness structure 16 comprises a substantially round or annular member 44 formed of one or more harness segments 35 which are collectively or individually structured to form a substantially annular configuration. Further, the diameter of the annular configuration of member 40 is sufficient to pass over the head of the individual or alternatively be disposed in surrounding relation to the neck of the individual so as to rest in overlying relation to the shoulders. In such an orientation, a plurality of restraint members 23 are removably or fixedly secured to spaced apart portions of the annular harness structure 16 by virtue of the placement of spaced apart connectors 33 as indicated. Further, the mounting and/or removal of the annular harness structure 16 may be facilitated by the placement of a buckle, Velcro type connector or other connecting facilities which serve to removably connect correspondingly disposed free ends as indicated.

Yet another preferred embodiment of the stabilizing assembly 10 of the present invention comprises the anchoring assembly 20 (see FIGS. 2 and 2A) including a support segment 50 mounted on or defining at least a portion of the support platform 28 and being structured to be movable relative thereto. In this preferred embodiment, the wheelchair or other support structure on which the participating individual is seated may be mounted directly on the exposed surface of the support segment 50. Moreover, when the support segment 50 is unlocked or movably connected relative to the support platform 28 the rotational or angular orientation of the individual while seated on the wheelchair or support structure can be changed so as to reach or access any of a plurality of different exercise devices associated with the overall exercise assembly. This eliminates the necessity of extensive movement or repositioning of the individual and the wheelchair, relative to various portions of a somewhat conventional exercise assembly in order to perform a plurality of different exercises as is common with modern day exercise equipment.

In order to facilitate the intended stability of the individual, regardless of the orientation chosen, a plurality of locking structures as at 52 may be disposed in interconnecting relation between the support platform 28 and the rotational support segment 50. Each of the one or more locking structures 52 is disposed and structured to facilitate the locked or fixed positioning of the support segment 50 in any of a plurality of different intended orientations relative to the support platform 28. Moreover, the rotation or other appropriate movement 54 of the support segment relative to the support platform is schematically indicated by directional arrow 54. Such relative movement of the support segment may be accomplished by a bearing and bearing race assembly disposed in interconnecting relation between cooperatively structured and correspondingly disposed portions of the support platform 28 and the support segment 50.

As set forth above, the support platform 28 of the anchor assembly 20 is disposed in underlying, supporting relation to a wheelchair or other support structure on which the individual is seated. Therefore, the weight of the wheelchair or other support structure as well as that of the individual serves to maintain the anchor assembly 20 and more specifically the support platform 28 in an intended position. While disposed in this intended, anchored position, the support platform 28 will be fixed relative to the floor or other surface on which it is mounted. In contrast, the support segment 50 may be allowed to at least minimally rotate, as indicated by directional arrow 54, in order to selectively change the orientation of the individual while in the wheelchair in order to use any of a plurality of different exercise apparatus associated with an overall combined exercise assembly.

Therefore, the stabilizing assembly 10 of the present invention, including its various structural and operative components described above, appears to overcome many of the deficiencies and disadvantages associated with known assemblies attempting to stabilize an individual while performing exercise in a seated orientation. In doing so, the stabilizing assembly 10 is removably and adjustably secured directly to the individual or more specifically, the various portions of the individual's body most predominantly associated with the exercise being performed. In addition, the various features of the stabilizing assembly 10 allow it to be used with conventional exercising equipment rather than requiring customizing of either the exercise equipment, the wheelchair or other support structure on which the individual is seated or other apparatus at least partially associated with the exercise of an individual while in a seated orientation.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described.

What is claimed is:

1. An assembly for stabilizing a seated individual while exercising, said assembly comprising:

a harness assembly including at least one harness structure, said harness structure secured to a predetermined portion of the individual dependent on the exercise being performed, a restraint assembly connected to said harness assembly and disposable relative thereto into a plurality of restraining positions, an anchor assembly connected to said restraint assembly, said restraint assembly comprising a plurality of restraint members each connected to said harness assembly and said anchor assembly, and said restraint assembly and said anchor assembly cooperatively disposed and structured to maintain said harness structure and at least a corresponding portion of the individual in an operative position during exercise.

2. An assembly as recited in claim 1 wherein said anchor assembly is disposed in supporting relation to the individual.

3. An assembly as recited in claim 2 wherein said anchor assembly comprises a support platform disposed in underlying relation to the individual and a plurality of attachment structures removably connectable to said restraint assembly.

4. An assembly as recited in claim 3 wherein said support platform comprises at least one support segment movable with the individual and relative to a remainder of the support platform.

5. An assembly as recited in claim 4 wherein said support segment is rotatable relative to said remainder of said support platform and structured to facilitate a change in orientation of the individual relative to the support platform.

6. An assembly as recited in claim 5 wherein said plurality of attachment structures are disposed in predetermined spaced relation to one another about said supporting surface.

7. An assembly as recited in claim 1 wherein said harness structure comprises a plurality of harness segments collectively dimensioned and configured to maintain the predetermined portion of the individual in said operative position.

8. An assembly as recited in claim 7 wherein said plurality of harness segments substantially define a vest securable to an upper torso portion of the individual.

9. An assembly as recited in claim 8 wherein at least some of said plurality of harness segments of said vest are disposed in surrounding relation to chest and back portions of the individual.

10. An assembly as recited in claim 8 wherein said plurality of harness segments of said vest comprise shoulder straps disposed in overlying relation to shoulders of the individual.

11. An assembly as recited in claim 10 wherein said vest further comprises an auxiliary member including a rigid material bar connected to said shoulder straps.

12. An assembly as recited in claim 11 wherein said bar is disposed outwardly from a frontal portion of the vest in connected relation to said restraint assembly.

13. An assembly as recited in claim 8 wherein at least some of said plurality of harness segments of said vest are disposed in substantially surrounding relation to a waist portion of the individual.

14. An assembly as recited in claim 7 wherein said plurality of harness segments comprise a lap assembly disposed in overlying engagement with at least the upper thighs of the individual.

15. An assembly as recited in claim 7 wherein said harness structure is dimensioned and configured to at least partially surround different portions of the individual dependent on the exercise being performed.

16. An assembly as recited in claim 15 wherein said harness structure comprises a substantially annular configuration dimensioned to surround a neck area and be disposed in overlying relation to a shoulder area of the individual.

17. An assembly as recited in claim 15 wherein said harness structure comprises a substantially annular configuration dimensioned to surround a waist area of the individual.

18. An assembly as recited in claim 1 wherein said plurality of restraint members are removably connected to said anchor assembly.

19. An assembly as recited in claim 18 wherein said plurality of restraint members are removably connected to said harness assembly.

20. An assembly as recited in claim 18 wherein said plurality of restraint members are connected to both said harness assembly and said anchor assembly at predetermined spaced apart locations dependent at least in part on a configuration of the harness assembly and the exercise being performed.

21. An assembly for stabilizing a seated individual while exercising, said assembly comprising:

a harness assembly comprising a plurality of harness structures, each of said plurality of harness structures configured to be secured to a different predetermined portion of the individual, at least one of said harness structures comprising a lap assembly disposed in overlying engagement with at least the upper thighs of the individual, an anchor assembly connectable to said harness assembly and disposed and structured to stabilize the individual, and a restraint assembly disposed in interconnecting relation between said harness assembly and said anchor assembly and selectively disposable relative there between to maintain the harness assembly and a corresponding portion of the individual in an operative position during exercise.

22. An assembly for stabilizing a seated individual while exercising, said assembly comprising:

a harness assembly including at least one harness structure, said harness structure secured to a predetermined portion of the individual dependent on the exercise being performed, a restraint assembly connected to said harness assembly and disposable relative thereto into a plurality of restraining positions, an anchor assembly connected to said constraint assembly and disposed in supporting relation to the individual, said anchor assembly comprising a plurality of attachment structures disposed in predetermined spaced relation to one another and removably connectable to said restraint assembly, and said plurality of restraint members are removably connected to said anchor assembly.

23. An assembly as recited in claim 22 wherein said predetermined spaced relation accommodates selective disposition of said restraint assembly relative to said anchor assembly depending at least partially on the exercise being performed.

24. An assembly for stabilizing a seated individual while exercising, said assembly comprising:

a harness assembly comprising a plurality of harness structures, each of said plurality of harness structures configured to be secured to a different predetermined portion of the individual, an anchor assembly connectable to said harness assembly and comprising a support platform disposed in underlying, supporting and stabilizing relation to the individual, a restraint assembly disposed in interconnecting relation between said harness assembly and said anchor assembly; said support platform comprising a plurality of attachment structures disposed in spaced relation to one another and structured to be connected to said restraint assembly, and said restraint assembly selectively disposable between said harness assembly and said anchor assembly to maintain said harness assembly and a corresponding portion of the individual in an operative position during exercise.

25. An assembly as recited in claim 24 wherein different ones of said plurality of attachment members are connected to said restraint assembly dependent on which of said plurality of harness structures are secured to the individual.

26. An assembly as recited in claim 25 wherein said restraint assembly comprises a plurality of restraint members each connectable to said anchor assembly and at least some connected to a common one of said plurality of harness structures.

27. An assembly as recited in claim 24 wherein each of said harness structures comprises one or more harness segments collectively dimensioned and configured to maintain the corresponding portion of the individual in said operative position.

28. An assembly as recited in claim 27 wherein said one or more harness segments comprise a vest securable to an upper torso portion of the individual.

29. An assembly as recited in claim 28 wherein said vest further comprises an auxiliary member including a rigid material bar connected to shoulder strap portions of said vest, said bar disposed outwardly from a frontal portion of said vest in connected relation to said restraint assembly.

30. An assembly as recited in claim 24 wherein at least one of said harness structures comprises a substantially annular configuration dimensioned to surround a neck area and disposed in overlying relation to a shoulder area of the individual.

31. An assembly as recited in claim 30 wherein said substantially annular configuration is dimensioned to surround a waist area of the individual.

* * * * *